US009679710B1

(12) United States Patent
Schaar

(10) Patent No.: US 9,679,710 B1
(45) Date of Patent: Jun. 13, 2017

(54) SWITCHING MODULE CONTROLLER FOR A VOLTAGE REGULATOR

(71) Applicant: Jonathan Michael Schaar, Waukesha, WI (US)

(72) Inventor: Jonathan Michael Schaar, Waukesha, WI (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 15/146,505

(22) Filed: May 4, 2016

(51) Int. Cl.
*G05F 1/14* (2006.01)
*H01H 9/00* (2006.01)

(52) U.S. Cl.
CPC ..... *H01H 9/0033* (2013.01); *H01H 9/0038* (2013.01); *G05F 1/14* (2013.01)

(58) Field of Classification Search
CPC ..... H02M 7/00; H02M 7/043; H02M 2001/0003; H02M 2007/217; G05F 1/14; G05F 1/147; G05F 1/153; G05F 1/16; G05F 1/20; G05F 1/253; G05F 1/33; G05F 1/34; G05F 1/38; H01H 9/0005; H01H 9/0011; H01H 9/0016; H01H 9/0027; H01H 9/0033
See application file for complete search history.

(56) References Cited

U.S. PATENT DOCUMENTS 3,206,580 A 9/1965 McCarty
3,594,631 A 7/1971 Trachsel
3,612,786 A 10/1971 Whitman
3,735,243 A 5/1973 Downs et al.
3,789,688 A 2/1974 Minks
4,090,225 A * 5/1978 Gilker ..... G01R 31/00 361/3
5,107,200 A 4/1992 Dohnal et al.
(Continued)

FOREIGN PATENT DOCUMENTS

DE 102010008974 A1 8/2011
DE 202012100603 U1 3/2012
(Continued)

OTHER PUBLICATIONS

European Search Report From Corresponding Application No. 14765113.7, Mailed Nov. 15, 2016 (9 pages).

*Primary Examiner* — Matthew Nguyen
(74) *Attorney, Agent, or Firm* — King & Spalding LLP

(57) ABSTRACT

A voltage regulator comprising a tap selector switch, a switching module and a switching module controller. The tap selector can comprise stationary contacts and movable contacts which can be adjusted for regulating the voltage between a source and a load. The switching module can comprise first and second bypass switches controlled by a bypass actuator and a non-arcing switch, such as a vacuum interrupter, controlled by an interrupter actuator. The switching module controller can be configured to perform a tap change operation through a series of steps that involve actuating a bypass switch and the non-arcing switch. In one example, the switching module controller can wait a predetermined amount of time before proceeding with each step of the tap change operation. In other examples, the switching module controller can receive signals or measurements from the system before proceeding with each step of the tap change operation.

20 Claims, 6 Drawing Sheets

(56) References Cited

U.S. PATENT DOCUMENTS

| | | | | |
|---|---|---|---|---|
| 5,128,605 | A | 7/1992 | Dohnal et al. | |
| 5,266,759 | A | 11/1993 | Dohnal et al. | |
| 5,428,551 | A | 6/1995 | Trainor et al. | |
| 5,550,460 | A | 8/1996 | Bellin et al. | |
| 5,568,398 | A | 10/1996 | Trainor | |
| 5,619,121 | A | 4/1997 | Trainor | |
| 5,821,716 | A | 10/1998 | Okanik | |
| 6,060,669 | A | 5/2000 | Dohnal et al. | |
| 6,072,305 | A | 6/2000 | Trainor et al. | |
| 6,100,674 | A | 8/2000 | Dohnal et al. | |
| 7,319,309 | B1 | 1/2008 | Cannon et al. | |
| 7,417,411 | B2 | 8/2008 | Hoffman et al. | |
| 7,463,010 | B2 | 12/2008 | Dohnal et al. | |
| 8,274,349 | B2 * | 9/2012 | Dunford | H01F 29/04 336/12 |
| 9,349,547 | B2 * | 5/2016 | Schaar | H01H 9/0038 |
| 2006/0068242 | A1 | 3/2006 | Norimatsu et al. | |
| 2010/0141047 | A1 | 6/2010 | Gibbs et al. | |
| 2011/0297517 | A1 | 12/2011 | Armstrong et al. | |
| 2014/0167529 | A1 | 6/2014 | Teising et al. | |
| 2015/0035538 | A1 | 2/2015 | Bieringer et al. | |
| 2015/0061806 | A1 | 3/2015 | Teising et al. | |
| 2015/0185743 | A1 * | 7/2015 | McFetridge | G05F 1/10 700/298 |
| 2016/0269019 | A1 * | 9/2016 | Petersen | G05F 1/14 |

FOREIGN PATENT DOCUMENTS

| | | | |
|---|---|---|---|
| EP | 2409398 | B1 | 1/2013 |
| EP | 2541572 | A1 | 1/2013 |
| EP | 2443641 | B1 | 12/2014 |
| EP | 2689442 | B1 | 1/2015 |
| GB | 1340356 | A | 12/1973 |
| JP | 2281718 | A | 11/1990 |
| RU | 1838844 | A3 | 8/1993 |
| RU | 2115187 | C1 | 7/1998 |

* cited by examiner

SWITCHING MODULE CONTROLLER FOR A VOLTAGE REGULATOR

RELATED APPLICATIONS

The present application is related to and incorporates by reference in its entirety U.S. patent application Ser. No. 14/213,384, filed Mar. 14, 2014, and titled "Switching Module for Voltage Regulator."

TECHNICAL FIELD

Embodiments described herein relate generally to voltage regulators, and more particularly to systems, methods, and devices for controlling a switching module of a voltage regulator.

BACKGROUND

Tap changers for voltage regulation in uninterrupted switching applications using the principle of reactor switching may include one or more vacuum interrupters to prolong the switching life of the device and avoid fouling the dielectric fluid. Vacuum interrupters have been used in load tap changers to regulate the voltage in power transformers for several decades. In U.S. Pat. No. 3,206,580, McCarty describes an invention mechanically linking one vacuum interrupter and two bypass switches. In U.S. Pat. No. 5,266,759, Dohnal and Neumeyer document substantial improvements to such a system. In these examples, complex linkages are used to transmit actuation forces and mechanically synchronize the tap selector, the bypass switches and the vacuum interrupter, which must all be in close proximity to one another. Thus the tap selector, bypass switches and vacuum interrupter are all built into one large assembly, which complicates manufacturing, assembly, and maintenance processes.

In recent years, alternatives have been proposed to simplify the system by decoupling subsystems and using additional motorized actuators. In U.S. Pat. No. 7,463,010, Dohnal and Schmidbauer describe improvements using separate drive systems for various switching subsystems of the tap changer. Alternatively, in U.S. Patent Publication No. 2011/0297517, Armstrong and Sohail describe a system using two vacuum interrupters, one for each moving contact of the tap selector mechanism, with each vacuum interrupter being actuated by a motorized actuator. Both of these solutions provide substantial improvements to simplify the mechanical systems, however it is the point of the present disclosure to provide further improvements. Dohnal and Schmidbauer's invention maintains a level of mechanical complexity within the vacuum interrupter and bypass switch assembly as it relies upon the use of cams and a parallelogram linkage. The two vacuum-interrupter solution provided by Armstrong and Sohail has cost disadvantages due to the expense of using a second vacuum interrupter as well as a robust drive assembly to overcome contact welding since the vacuum interrupters in such a configuration must be able to withstand fault current loads. For overall cost and performance reasons, the use of one vacuum interrupter with two bypass switches is generally accepted as the preferred method.

As background, FIG. 1 illustrates a typical voltage regulator tap switching circuit 100 for a reactive switching on-load tap changer as is commonly used in a distribution substation transformer. The voltage regulator tap switching circuit 100 includes a tap selector 110, a portion of the series winding 105, a reactor 140 (such as a preventative autotransformer), a switching subassembly 150, and a terminal 165 which could be connected to either the source or load. The series winding 105 is an integral part of the voltage regulator's transformer core and coil assembly. An equalizer winding (not shown) may be included or omitted from the circuit at the designer's discretion. The preventative autotransformer 140 is a separate subassembly as is the tap selector 110.

Within the tap selector 110, there are a plurality of stationary contacts 115 and 120 which are electrically connected to taps in the series winding 105. In certain cases, there may be more stationary contacts connected to the series winding. Movable contacts 125, 130, connect stationary contacts 115, 120 through the preventative autotransformer 140 to the source or load terminal 165.

The switching subassembly 150 consists of bypass switches 152, 154, and a vacuum interrupter 156. The operation of these switches is explained thoroughly in U.S. Pat. No. 5,107,200 to Dohnal and Neumeyer. To actuate and synchronize the switching subassembly 150 to the tap selector switch 110, there is a mechanical linkage 160, which is actuated by an actuator (not shown). The actuator moves the mechanical linkage 160, to position the movable contacts 125, 130 on the appropriate stationary contact to regulate the voltage between the source and load. In practice, the mechanical linkage 160 is a complex design of shafts, gears, cams, bearings and other mechanical components, all of which require a high degree of component-level and assembly-level precision to function properly. Further, the mechanical linkage 160 creates challenges to efficiently packaging the system due to mechanical constraints of power transmission. As a result, there are cost and manufacturing limitations with known voltage regulator solutions.

SUMMARY

In general, in one aspect, the disclosure relates to a voltage regulator comprising a tap selector, a switching module, and a switching module controller. The tap selector can comprise stationary contacts and movable contacts which can be adjusted for regulating the voltage between a source and a load. The switching module can comprise first and second bypass switches controlled by a bypass actuator and a non-arcing switch, such as a vacuum interrupter, controlled by an interrupter actuator. The switching module controller can be configured to perform a tap change using the following steps: receive a command from a voltage regulator control to move a first movable contact; determine a position of the first movable contact and the second movable contact; actuate the bypass actuator to open the first bypass switch and wait a first predetermined time; actuate the interrupter actuator to open the interrupter and wait a second predetermined time; actuate the tap selector switch to move the first movable contact and wait a third predetermined time; actuate the interrupter actuator to close the interrupter and wait a fourth predetermined time; and actuate the bypass actuator to close the first bypass switch.

In another aspect, the disclosure can relate to a voltage regulator comprising a tap selector, a switching module, and a switching module controller. The tap selector can comprise stationary contacts and movable contacts which can be adjusted for regulating the voltage between a source and a load. The switching module can comprise first and second bypass switches controlled by a bypass actuator and a non-arcing switch, such as a vacuum interrupter, controlled by an interrupter actuator. The switching module controller can be configured to perform a tap change using the following steps: receive a command from a voltage regulator control to move a first movable contact; determine a position of the first movable contact and the second movable contact; actuate the bypass actuator to open the first bypass switch; receive a first signal from a sensor that the first bypass switch is open; actuate the interrupter actuator to open the interrupter; receive a second signal from the sensor that the interrupter is open; actuate the tap selector switch to move the first movable contact and determine that the first movable contact is in the new position; actuate the interrupter actuator to close the interrupter; receive a third signal from a sensor that the interrupter is closed; and actuate the bypass actuator to close the first bypass switch.

In yet another aspect, the disclosure can relate to a voltage regulator comprising a tap selector, a switching module, and a switching module controller. The tap selector can comprise stationary contacts and movable contacts which can be adjusted for regulating the voltage between a source and a load. The switching module can comprise first and second bypass switches controlled by a bypass actuator and a non-arcing switch, such as a vacuum interrupter, controlled by an interrupter actuator. The switching module controller can be configured to perform a tap change using the following steps: receive a command from a voltage regulator control to move a first movable contact; determine a position of the first movable contact and the second movable contact; receive a baseline measurement of the current at the interrupter; actuate the bypass actuator to open the first bypass switch; receive a first measurement of the current at the interrupter indicating that the first bypass switch is open; actuate the interrupter actuator to open the interrupter; receive a second measurement of the current at the interrupter indicating that the interrupter is open; actuate the tap selector switch to move the first movable contact and determine that the first movable contact is in the new position; actuate the interrupter actuator to close the interrupter; receive a third measurement of the current at the interrupter indicating that the interrupter is closed; and actuate the bypass actuator to close the first bypass switch.

These and other aspects, objects, features, and embodiments will be apparent from the following description and the appended claims.

BRIEF DESCRIPTION OF THE DRAWINGS

The drawings illustrate only example embodiments of a switching module controller of a voltage regulator and are therefore not to be considered limiting of its scope, as switching module controllers for voltage regulators may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
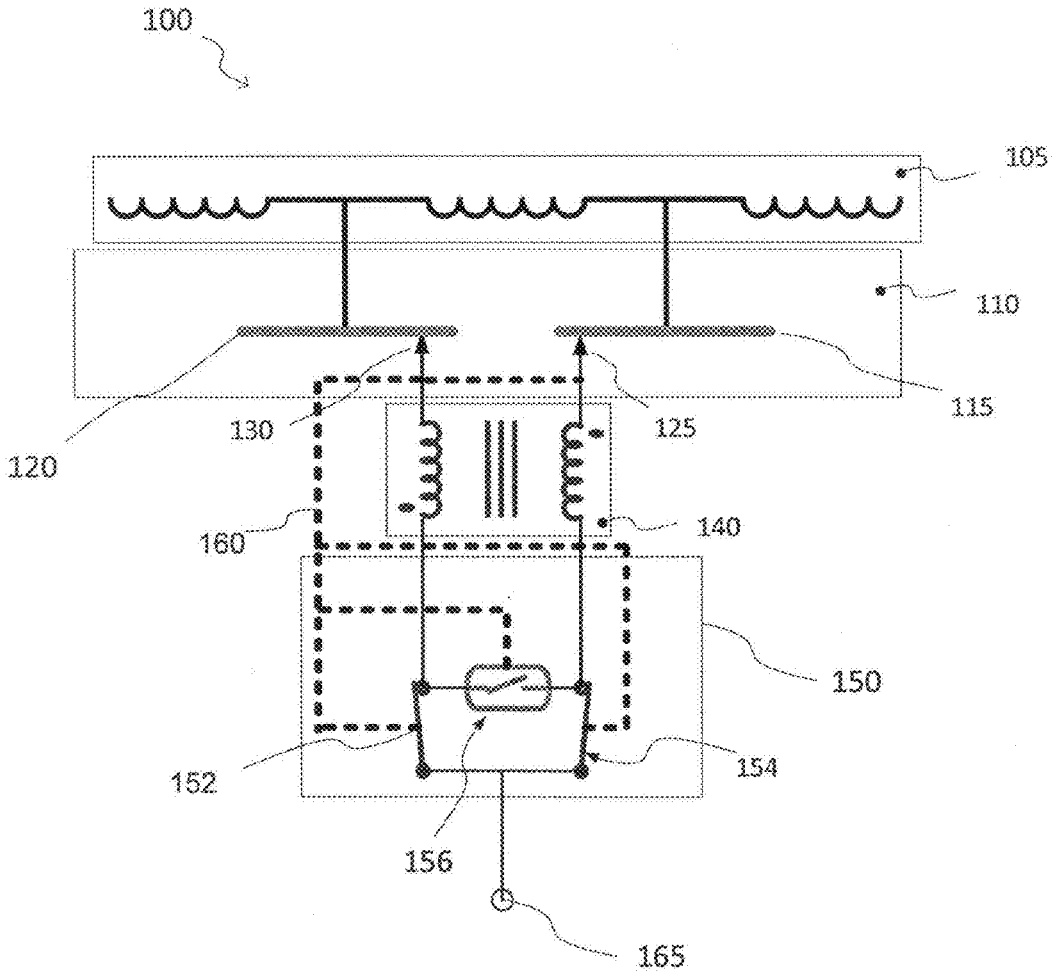
Figure 1 (Prior Art)
FIG. 1 shows an example of a voltage regulator used in a power distribution substation transformer as known in the prior art.

The example embodiments discussed herein are directed to systems, apparatuses, and methods of controlling a switching module of a voltage regulator. While example embodiments are described herein as being directed to voltage regulators used in medium and high voltage electric distribution systems of a power grid, example embodiments can also be used with voltage regulators in other types of systems. As described herein, a user can be any person that interacts with a voltage regulator. Examples of a user may include, but are not limited to, a consumer, an electrician, an engineer, a lineman, a consultant, a contractor, an instrumentation and controls technician, an operator, and a manufacturer's representative.

In one or more example embodiments, a voltage regulator is subject to meeting certain standards and/or requirements. Examples of entities that set and/or maintain such standards can include, but are not limited to, the International Electrotechnical Commission (IEC), the National Electric Code (NEC), the National Electrical Manufacturers Association (NEMA), and the Institute of Electrical and Electronics Engineers (IEEE). Example embodiments are designed to be used in compliance with any applicable standards and/or regulations.

As described herein, communication between two or more components of an example voltage regulator is the transfer of any of a number of types of signals. Examples of signals can include, but are not limited to, power signals, control signals, communication signals, data signals, instructions, and status reporting. In other words, communication between components of example voltage regulators can involve the transfer of power (e.g., high levels of current, high levels of voltage), control (e.g., low voltage, low current), and/or data.

Any component described in one or more figures herein can apply to any subsequent figures having the same label. In other words, the description for any component of a subsequent (or other) figure can be considered substantially the same as the corresponding component described with respect to a previous (or other) figure. For any figure shown and described herein, one or more of the components may be omitted, added, repeated, and/or substituted. Accordingly, embodiments shown in a particular figure should not be considered limited to the specific arrangements of components shown in such figure.

Example embodiments of systems and methods for controlling a switching module of a voltage regulator will be described more fully hereinafter with reference to the accompanying drawings, in which example voltage regulator systems are shown. Voltage regulator systems may, however, be embodied in many different forms and should not be construed as limited to the example embodiments set forth herein. Rather, these example embodiments are provided so that this disclosure will be thorough and complete, and will fully convey the scope of voltage regulator systems to those of ordinary skill in the art. Like, but not necessarily the same, elements (also sometimes called components) in the various figures are denoted by like reference numerals for consistency.

Terms such as "first" and "second" are used merely to distinguish one component (or part of a component or state of a component) from another. Such terms are not meant to denote a preference or a particular orientation. Also, the names given to various components described herein are descriptive of one embodiment and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

Figure 2:
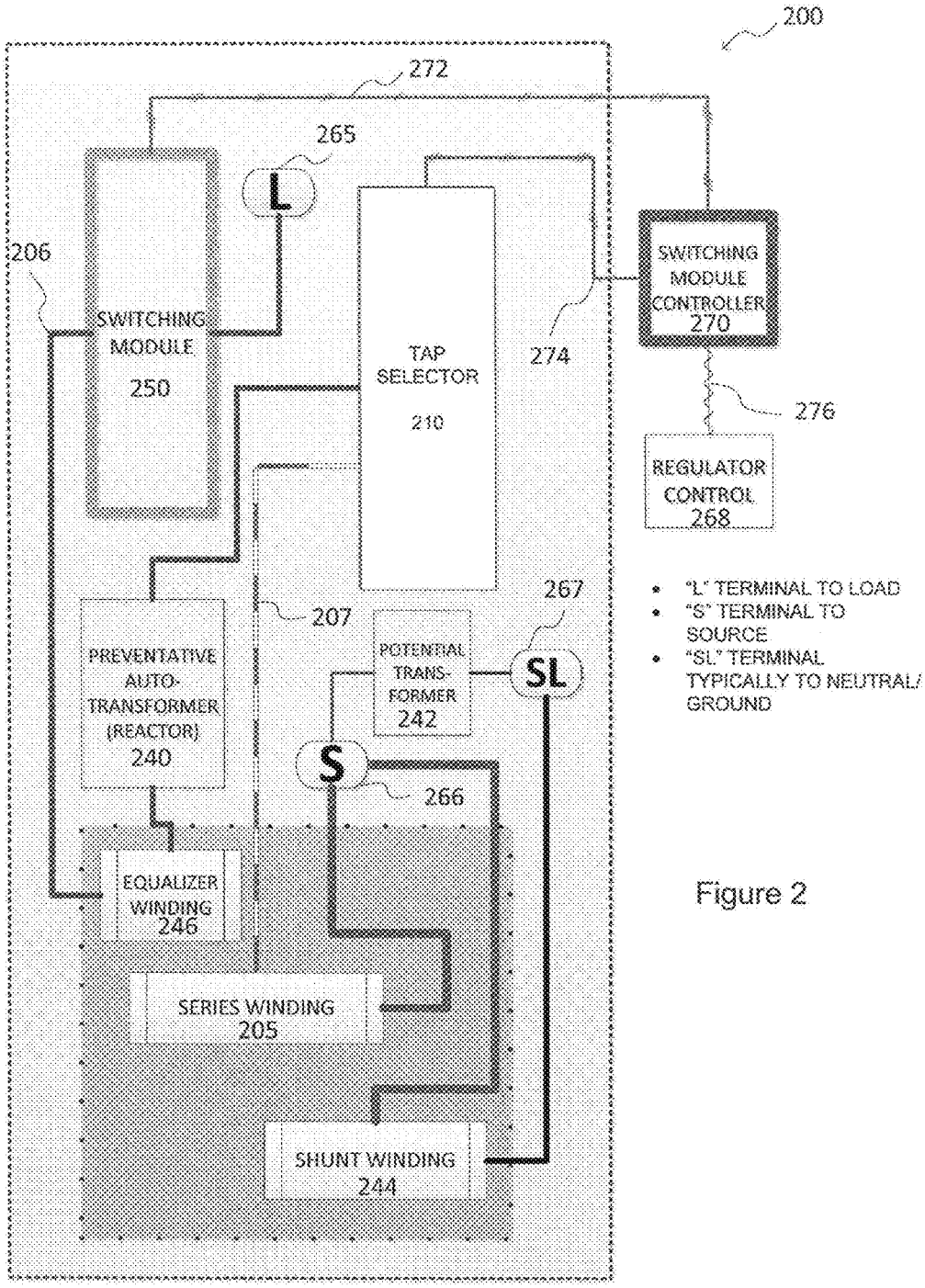
FIG. 2 shows a system diagram for a voltage regulator with a switching module controller in accordance with certain example embodiments of the disclosure.

Referring now to FIG. 2, a schematic diagram is shown of a voltage regulator system 200 with a switching module and switching module controller in accordance with certain example embodiments. As found in a conventional voltage regulator, the example voltage regulator system 200 comprises a series winding 205 electrically coupled via connection 207 to tap selector 210, the series winding 205 and tap selector 210 electrically coupled between a load terminal 265 and a source terminal 266. The example voltage regulator system 200 also comprises a neutral or ground terminal 267, a reactor 240 (such as a preventative auto-transformer) for providing an impedance that prevents short circuits when taps are moved, and a regulator control 268 for initiating commands to perform tap changes in order to adjust the voltage between the load terminal 265 and the source terminal 266. A shunt winding 244 is magnetically coupled to the series winding 205 to induce a voltage differential across the series winging 205. The potential transformer 242 is an optional component that can be used to make voltage measurements in certain embodiments of the present disclosure. Similarly, the equalizer winding 246 is an optional component used in conjunction with the reactor 240. Those of skill in this field will recognize that in alternate embodiments of the present disclosure, one or more of the components described as optional can be removed from the example voltage regulator system 200.

In the example voltage regulator system 200, the switching module 250 is electrically coupled to the tap selector 210 through the equalizer winding 246 and the reactor 240 via connection 206. Connection 206, connection 207 and the other electrical connections are illustrated in the example schematic of FIG. 2 as a single line for simplicity, but those of skill in this field will recognize that these connections can be implemented with multiple conductors. As described further in connection with FIGS. 3 and 4, the switching module 250 typically comprises a first and second bypass switch, an interrupter, and one or more actuators. Unlike the prior art switching module 150 illustrated in FIG. 1, the voltage regulator system 200 does not include a mechanical linkage controlling the sequence and timing with respect to the movement of the bypass switches, the interrupter, and the tap selector's movable contacts. Instead, in the example voltage regulator system 200, the sequence and timing for moving the bypass switches, the interrupter, and the movable contacts are controlled by the switching module controller 270.

The switching module controller 270 can be implemented with one or more integrated circuits, programmable logic controllers, or mechanical switches. The switching module controller 270 is electrically coupled to the switching module 250 via electrical connection 272 and controls the timing and sequence as to when the bypass switches and interrupter of the switching module 250 are actuated. The switching module controller 270 also can receive signals via electrical connection 272 from sensors located within the switching module 250. The switching module controller 270 also is electrically coupled to the tap selector 210 via electrical connection 274. The switching module controller 270 can receive signals, such as signals indicating the position of the tap selector, and transmit signals instructing movement of the tap selector, via the electrical connection 274. Lastly, the switching module controller 270 is electrically coupled to the regulator control 268 via electrical connection 276. The switching module controller 270 can receive instructions from the regulator control 268 as to when to perform a tap change and can report to the regulator control 268 status and diagnostic information from the switching module 250 and tap selector 210. The switching module controller 270 and the regulator control 268 may be incorporated into a single control with all of the capabilities of both controls to reduce component count and prevent the need to duplicate processors and hardware that could be shared.

Figure 3:
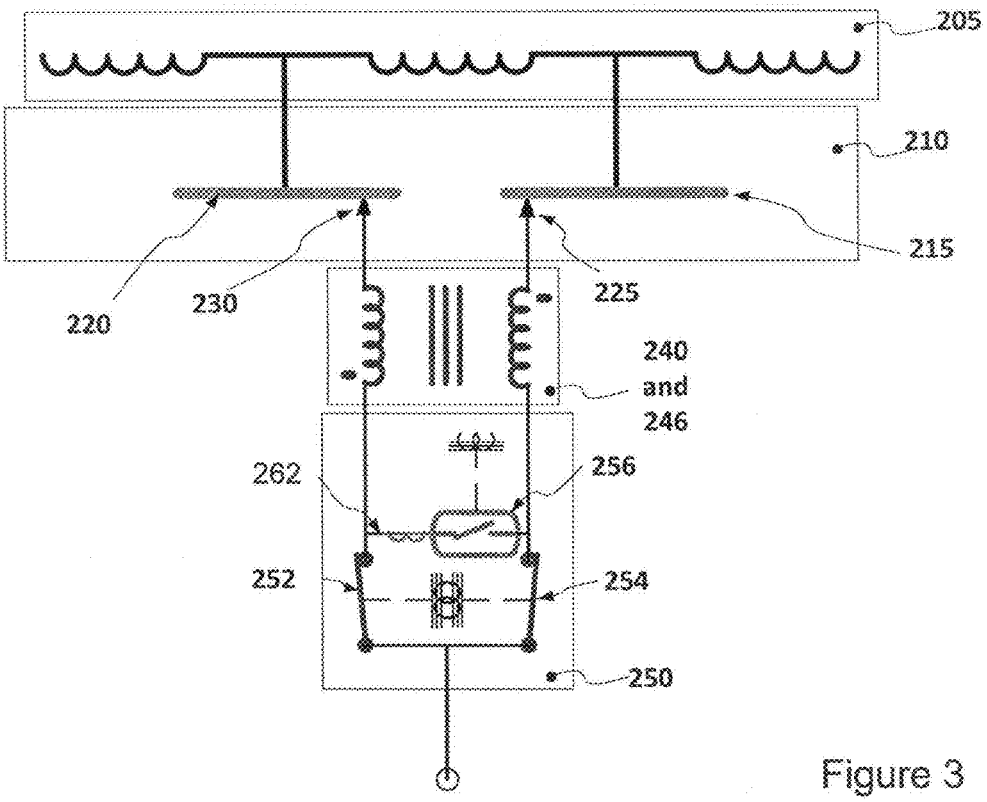
FIG. 3 shows a detailed system diagram of components of the voltage regulator with a switching module controller in accordance with certain example embodiments of the disclosure.
Figure 4:
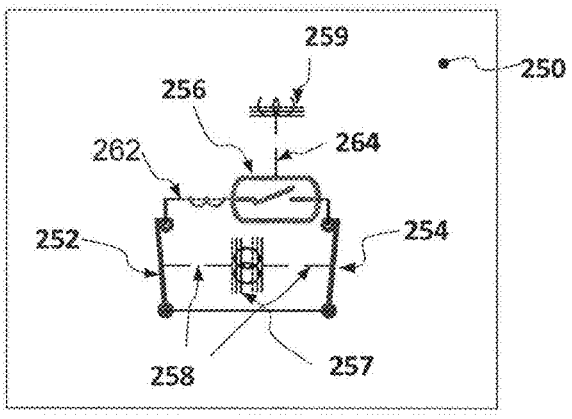
FIG. 4 shows a detailed system diagram of components of the switching module of the voltage regulator controller in accordance with certain example embodiments of the disclosure.

Referring now to FIGS. 3 and 4, more detailed schematic diagrams showing certain components of the example voltage regulator system 200 of FIG. 2 are shown. FIG. 3 illustrates the series winding 205 electrically coupled to the tap selector 210 and the tap selector 210 electrically coupled via the preventative auto-transformer 240 and optional equalizer winding 246 to the switching module 250. The example tap selector 210 comprises first and second stationary contacts 215 and 220 and first and second movable contacts 225 and 230. In alternate embodiments, the tap selector can have a greater number of stationary and movable contacts. In the example shown in FIG. 3, the switching module 250 comprises a first bypass switch 252, a second bypass switch 254, and an interrupter 256. The first and second bypass switches 252 and 254 are opened and closed by bypass actuator 257 and bypass linkage 258, wherein the bypass actuator is controlled by the switching module controller 270. Similarly, the interrupter 256 is opened and closed by the interrupter actuator 259 and interrupter linkage 264, wherein the interrupter actuator 259 is controlled by the switching module controller 270. In alternate embodiments of the present disclosure, a different number or arrangement of actuators can be implemented, including electronic gating means for actuating power electronic interrupting switches.

Lastly, the example components illustrated in FIGS. 3 and 4 show current sensor 262 located adjacent to the interrupter 256. The current sensor 262 can measure the current through the interrupter 256 in order to determine changes to the positions of the interrupter 256 and the first and second bypass switches 252 and 254. Measurements from the current sensor 262 can be transmitted to the switching module controller 270 via connection 272. The switching module controller 270 can use measurements from the current sensor 262 to control the steps of a tap change operation. In alternate embodiments of the present disclosure, more than one current sensor can be implemented or other types of sensors can be implemented in the switching module 250 such as sensors to detect the physical position of actuators or switches.

Figure 5:
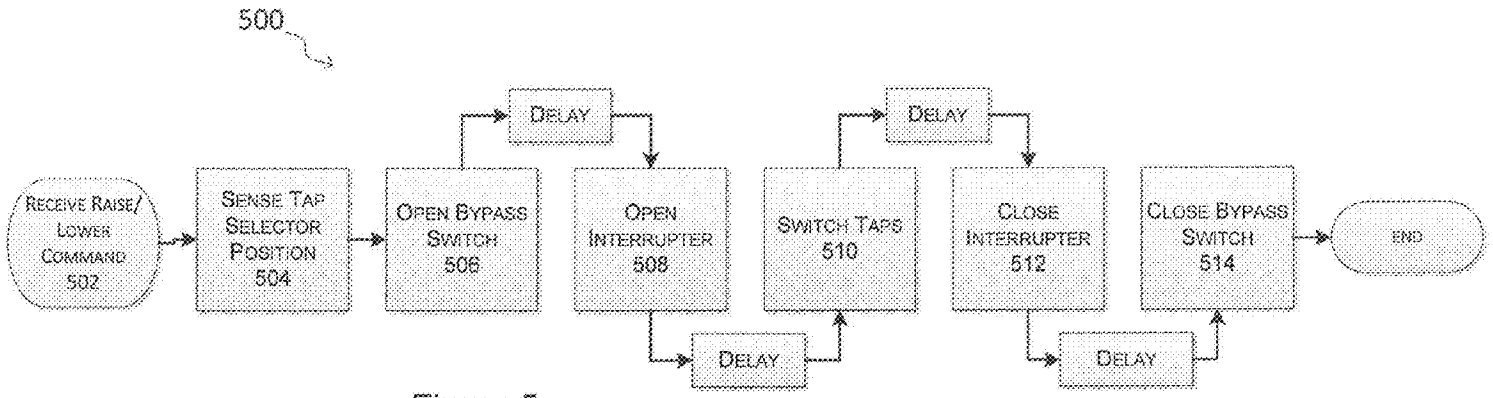
FIG. 5 shows an example of a flow chart diagram illustrating the operation of a switching module controller in accordance with certain example embodiments of the disclosure.
Figure 6:
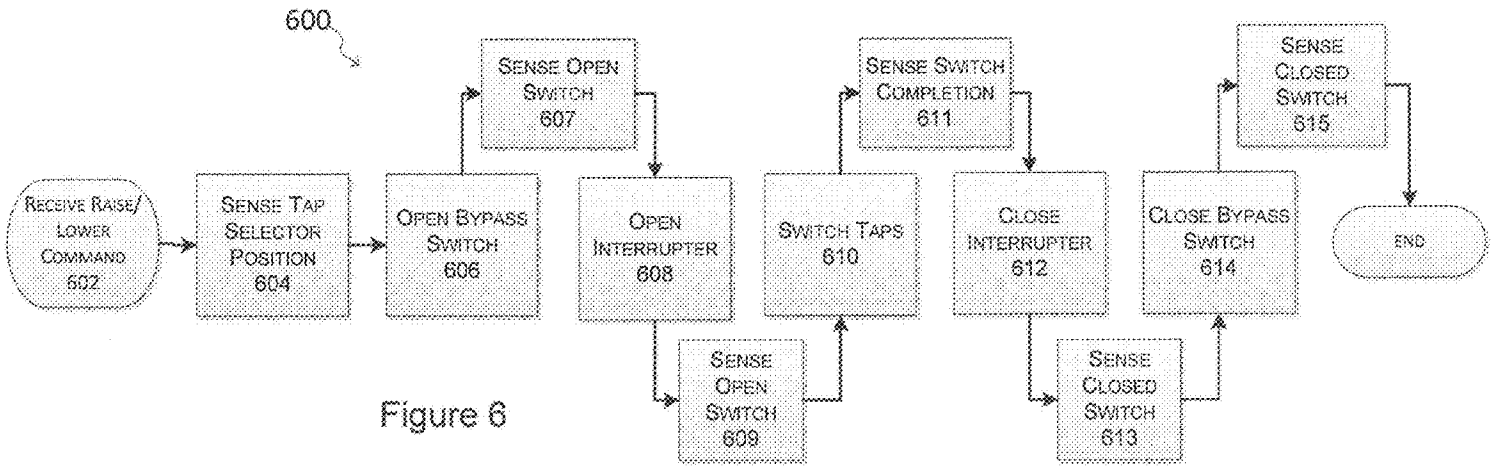
FIG. 6 shows another example of a flow chart diagram illustrating the operation of a switching module controller in accordance with certain example embodiments of the disclosure.
Figure 7:
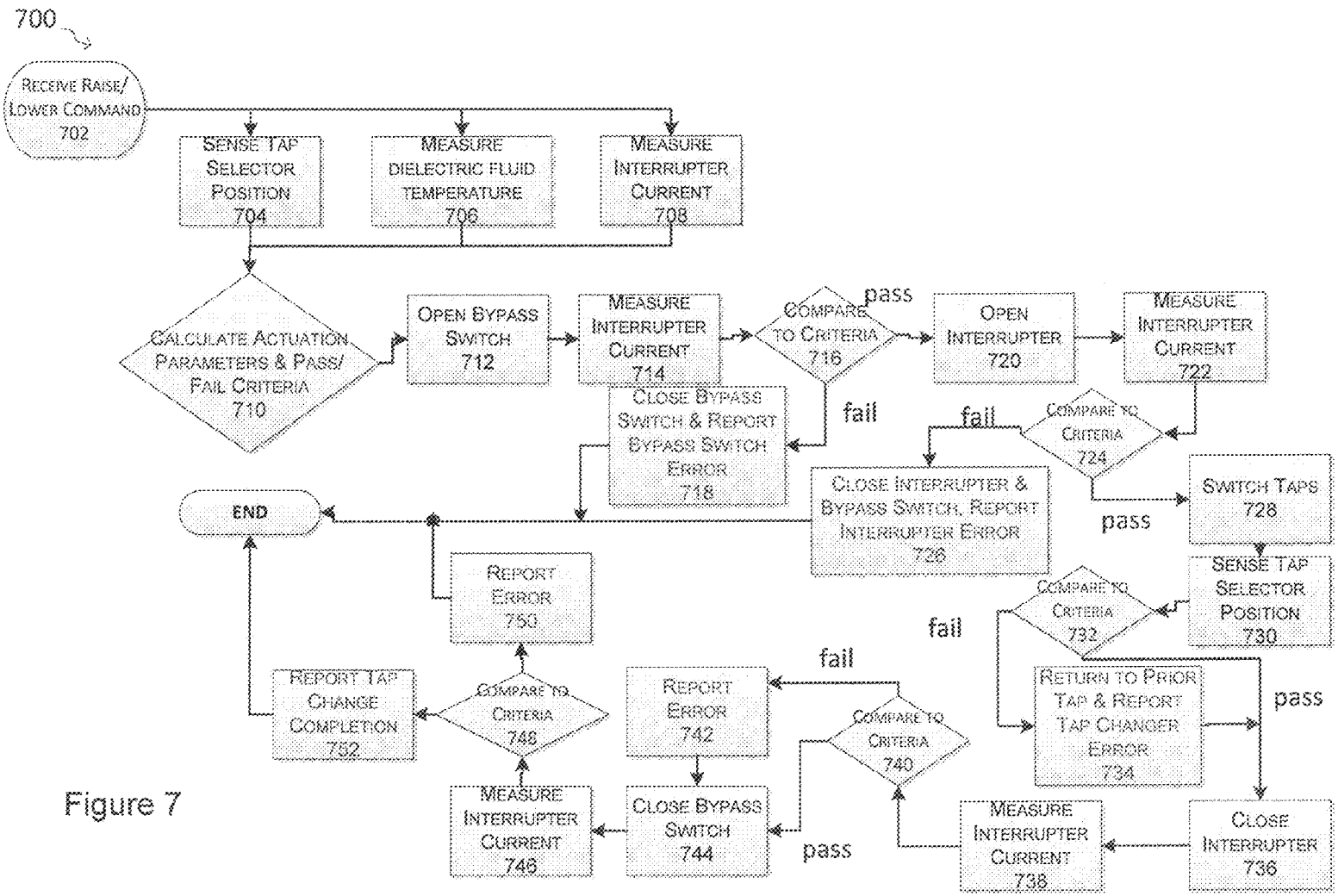
FIG. 7 shows another example of a flow chart diagram illustrating the operation of a switching module controller in accordance with certain example embodiments of the disclosure.

Turning to FIGS. 5, 6, and 7, three example methods for completing a tap change operation using the switching module controller 270 are illustrated. In each of the example methods shown in FIGS. 5, 6, and 7, the switching module controller 270 ensures that each step of the method is completed before moving to the next step. Controlling the sequence of the steps in each method is important to ensure that a tap is changed without arcing occurring within the voltage regulator. Those of skill in this field will recognize that the three example methods illustrated in FIGS. 5, 6, and 7 can be modified within the scope of the present disclosure. For example, the present disclosure encompasses other methods where certain steps can be added, removed, or performed in a different order than the methods shown in the examples of FIGS. 5, 6, and 7.

Referring to FIG. 5, example method 500 begins at step 502 with the switching module controller 270 receiving a command from the regulator control 268 to select the next higher or lower voltage position on the tap selector 210. In step 504, the switching module controller 270 can receive data via connection 274 indicating the positions of the movable contacts 225 and 230 in the tap selector 210 to coordinate the proper opening of bypass switch 252 with movable contact 230 or bypass switch 254 with movable contact 225. The switching module controller 270 can determine which combination of switches to activate based upon whether the movable contacts are presently on the same stationary contact or adjacent contacts and whether the command from the regulator control 268 is to move to a higher or lower position. In step 506, the switching module controller 270 sends a signal via connection 272 to bypass actuator 257 to open a first bypass switch, such as bypass switch 252. The switching module controller 270 then waits a first predetermined period of time to ensure that the bypass switch 252 is open before proceeding to step 508. The length of the predetermined period of time can be developed empirically and can be controlled by electrical or mechanical components within the switching module controller 270. The actuation time of bypass switches, tap selectors and mechanical-style interrupters depends on various factors such as component mass, spring force, fluid viscosity, friction, power applied, breaking current, recovery voltage, manufacturing variation and component wear. The designer must allow for timing variation and allow for a margin of safety based on these factors so that the sequence of operations is performed properly for reliable operation. Actuating components out of sequence can result in rapid deterioration of contacts and interruption of power to customers. Those of skill in this field can establish the predetermined periods of time between sequential operations through statistical analysis of testing under a range of input parameters to simulate the conditions that the tap changer may experience in application. Those of skill in this field also can use multivariable testing to establish reasonable maximum and minimum operating times of each component under a broad range of conditions such that the predetermined period of time for each operation can be minimized without compromising system reliability.

After the first predetermined period of time, the switching module controller 270 sends a signal via connection 272 to interrupter actuator 259 to open the interrupter 256 in step 508, and then the switching module controller 270 waits a second predetermined period of time before proceeding to step 510. In step 510, the switching module controller 270 sends a signal via connection 274 to an actuator (not shown) within the tap selector 210 to move a first movable contact, such as movable contact 230, to a new tap position. After waiting a third predetermined period of time to ensure the movement of the movable contact is complete, the switching module controller 270 sends a signal in step 512 via connection 272 to the interrupter actuator 259 to close the interrupter 256. After waiting a fourth predetermined period of time to ensure the interrupter 256 is closed, the switching module controller 270 sends a signal in step 514 via connection 272 to the bypass actuator 257 to close bypass switch 252. The example method 500 for completing a tap change operation using the switching module controller 270 is then complete.

Referring now to FIG. 6, another example method 600 for completing a tap change operation is illustrated. Example method 600 begins at step 602 with the switching module controller 270 receiving a command from the regulator control 268 to select the next higher or lower voltage position on the tap selector 210. In step 604, the switching module controller 270 can receive data via connection 274 indicating the positions of the movable contacts 225 and 230 in the tap selector 210. In step 606, the switching module controller 270 sends a signal via connection 272 to bypass actuator 257 to open a first bypass switch, such as bypass switch 252. In step 607, the switching module controller 270 receives a first signal from a sensor, such as a position sensor, indicating that bypass switch 252 is open. As one example, the position sensor can be implemented as current sensor 262 shown in FIG. 4. After confirming that the bypass switch is open, the switching module controller 270 sends a signal via connection 272 to interrupter actuator 259 to open interrupter 256 in step 608. In step 609, the switching module controller 270 receives a second signal from a sensor, such as a position sensor, indicating that interrupter 256 is open. Again, as one example, the position sensor can be implemented as current sensor 262 shown in FIG. 4.

After receiving confirmation that the interrupter 256 is open, it is then safe to move the contacts within the tap selector and in step 610 the switching module controller 270 sends a signal via connection 274 to an actuator (not shown) within the tap selector 210 to move a first movable contact, such as movable contact 230, to a new tap position. In step 611, the switching module controller 270 receives a third signal from the tap selector 210 via connection 274 indicating that the movement of the movable contact is complete. The switching module controller 270 then sends a signal in step 612 via connection 272 to the interrupter actuator 259 to close the interrupter 256. After receiving a fourth signal from a sensor within the switching module, such as a position sensor, in step 613 to ensure the interrupter 256 is closed, the switching module controller 270 sends a signal in step 614 via connection 272 to the bypass actuator 257 to close bypass switch 252. In step 615, the switching module controller 270 receives a fifth signal from a sensor within the switching module, such as a position sensor, indicating that the bypass switch 252 is closed. After confirming that the bypass switch 252 is closed, the example method 600 for completing a tap change operation using the switching module controller 270 is then complete. Failure to receive each signal indicating a successful switch operation within a predetermined time can cause the switching module controller 270 to reverse the operating steps to return the tap changer to the prior state and report an error signal to the regulator control 268. Successful completion of the tap change sequence can cause the switching module controller 270 to report a successful tap operation signal to the regulator control 268.

Referring now to FIG. 7, method 700 provides another example of a procedure for completing a tap change operation. Example method 700 is more complex than method 600 in that method 700 involves the switching module controller 270 receiving additional data about the voltage regulator and providing a reporting feature. Example method 700 begins at step 702 with the switching module controller 270 receiving a command from the regulator control 268 to select the next higher or lower voltage position on the tap selector 210. In step 704, the switching module controller 270 can receive data via connection 274 indicating the positions of the movable contacts 225 and 230 in the tap selector 210. In step 706, the switching module controller 270 can receive a reading of the temperature of the dielectric fluid within the voltage regulator system 200 from a temperature sensor. In step 708, a current sensor, such as current sensor 262, can provide the switching module controller 270 with a baseline current measurement of the amplitude and phase of the current through the interrupter 256. The amplitude and phase angle of current flowing through the interrupter 256 is affected by the various configurations of open and closed bypass switches 252 and 254 and the interrupter 256. When the interrupter 256 and bypass switches 252 and 254 are closed, load current is divided between the first bypass switch 252 and the second bypass switch 254. With the same switch configuration, the circulating current resulting from voltage and impedance of the series winding 205, the preventative autotransformer 240 and the optional equalizer winding 246 will divide between a first path through the interrupter 256 and a second path through the bypass switches 252 and 254. As a result, the baseline current measured through the interrupter 256 using current sensor 262 under these conditions will predominantly be a fraction of the total circulating current.

Referring to step 710, the switching module controller 270 can use the baseline current measurement and the tap selector position to calculate actuation parameters and criteria for each step of the tap change operation performed in method 700. For example, the switching module controller 270 can calculate expected current measurements and an expected time for completing each step involving the opening or closing of a switch or interrupter in the voltage regulator system 200. Other factors may be analyzed by the switching module controller 270 in determining actuating parameters and pass/fail criteria for decision making during the tap change operation. For instance, the fluid temperature may be measured, the number of operations accumulated by the various switches, and the historical response time of each switch may be factors known to affect the switching operations. Taking these factors into consideration, the switching module controller 270 may adjust the force of any of the actuators of the bypass switches 252 and 254, the interrupter 256 or the tap selector 210 to optimize switching performance. Additionally, the switching module controller 270 may adjust the allowable response time for any step in the tap changing process based on these factors.

Referring to step 712, the switching module controller 270 sends a signal via connection 272 to bypass actuator 257 to open a first bypass switch, such as bypass switch 252. In step 714, the switching module controller 270 receives a first current measurement from a sensor, such as current sensor 262. The switching module controller 270 compares the amplitude or phase of the first current measurement to the baseline current measurement to determine whether the bypass switch 252 opened properly. A first current measurement greater in amplitude than the baseline measurement indicates that either bypass switch 252 or 254 opened because all of the circulating current resulting from voltage and impedance of the series winding 205, the preventative autotransformer 240 and the optional equalizer winding 246 will be flowing through the interrupter rather than just a fraction of it as was the case during the baseline current measurement. In certain embodiments, the switching module controller 270 can also receive data regarding the load current measurement of the voltage regulator system 200, the circulating current measurement of the preventative auto-transformer, and the position of the first and second bypass switches to determine whether bypass switch 252 opened properly. The circulating current resulting from voltage and impedance of the series winding 205, the preventative autotransformer 240 and the optional equalizer winding 246 is almost purely reactive, so the circulating current is nearly 90 degrees out of phase to the system voltage. Load current, however, is generally significantly in phase with the system voltage so measuring the phase angle of the current through the interrupter can be used to determine the status of the bypass switches when the circulating current and load current are added together. Given sufficient load current, the phase angle of the first current measurement compared to the baseline measurement can be used to determine if the proper bypass switch opened because the phase angle will shift forward if one switch opens and backwards if the other switch opens based on the direction of power flow through the voltage regulator. To determine if the proper bypass switch opened with even greater confidence, the switching module controller 270 can calculate a first expected amplitude and phase angle of current if bypass switch 252 is opened or a second expected amplitude and phase angle of current if bypass switch 254 is opened based upon the total load current, voltage and phase angle as measured by the regulator control 268 through other current and voltage sensing means conventionally used, as well as the total expected circulating current of the preventative autotransformer circuit, and the known position of movable contacts 225 and 230. If the first measured amplitude and phase angle of current are sufficiently similar to the first or second expected amplitude and phase angle of current, the switching module controller can determine which bypass switch was opened.

If the switching module controller 270 determines in step 716 that the bypass switch did not open properly in step 712, method 700 proceeds to step 718 where the switching module controller 270 closes the bypass switch and provides an error report. If the switching module controller 270 determines in step 716 that the bypass switch opened properly in step 712, method 700 proceeds to step 720 where the switching module controller 270 opens the interrupter 256 by sending a command to the interrupter actuator 259 via connection 272. In step 722, the switching module controller 270 receives a second current measurement from a sensor, such as current sensor 262, to ensure, in step 724, that the current at interrupter 256 is equal to or close to zero. If the second current measurement is not equal to or close to zero in step 724, the method 700 proceeds to step 726 where the switching module controller 270 generates an error report and closes the interrupter and bypass switch by sending control signals via connection 272 to the actuators 257 and 259 of the switching module 250.

If the criteria in step 724 are satisfied to ensure there will not be arcing at the tap selector contacts, the method 700 proceeds to step 728 where the switching module controller 270 sends a signal via connection 274 to an actuator (not shown) within the tap selector 210 to move a first movable contact, such as movable contact 230, to a new tap position. In step 730, the switching module controller 270 receives a signal from the tap selector 210 via connection 274 indicating that the movement of the movable contact is complete. Verifying that the movement of the movable contact of the tap changer has completed properly can be accomplished in one of several ways. For example, the signal from the tap selector 210 can be generated by a position indicator or the seal-in/holding switch current of the tap selector motor can be measured. If the tap change for the movable contact is not completed within a certain time or there is no verification that the tap change was completed properly in step 732, the switching module controller 270 returns the movable contact to its position prior to the attempted tap change in step 728 and an error report is generated in step 734 before proceeding to step 736.

If the switching module controller 270 verifies that the tap change for the movable contact completed successfully, the example method 700 proceeds to step 736 where the switching module controller 270 sends a signal via connection 272 to the interrupter actuator 259 to close the interrupter 256. In step 738, the switching module controller 270 receives a third current measurement from the current sensor 262 to determine whether the interrupter 256 closed properly in step 736. The third current measurement can be compared to the baseline current measurement and the other previous current measurements in step 740 to determine whether the interrupter 256 is conducting properly. If the third current measurement does not satisfy the set criteria or other calculated criteria, the switching module controller 270 can generate an error report in step 742. Alternatively, if the criteria are satisfied in step 740, the switching module controller 270 sends a signal via connection 272 to the bypass actuator 257 to close the bypass switch in step 744.

In step 746, the switching module controller 270 receives a fourth current measurement from the current sensor 262 to determine whether the bypass switch closed properly in step 744. The switching module controller 270 can compare the fourth current measurement to the baseline current measurement and the other previous current measurements in step 748 to determine whether the bypass switch 252 closed properly. If the switching module controller 270 determines that the fourth current measurement does not pass the set criteria, the switching module controller 270 generates an error report in step 750. Alternatively, if the switching module controller 270 determines that the bypass switch 252 closed properly in step 744, the switching module controller 270 can generate a report, in step 752, indicating that the tap change procedure completed successfully.

In one or more of steps 716, 724, 732, 740, and 748, the switching module controller 270 can review a variety of criteria to determine whether the voltage regulator system 200 is operating properly. For example, in certain instances, the switching module controller 270 can compare a measured amount of time needed to complete each step to an expected amount of time. If the timing of one or more steps does not correspond to the expected amount of time needed to complete a step of the tap change operation, the switching module controller 270 can generate an error report.

Substantial differences in resistance between the bypass switches 252 and 254 may cause more or less of the circulating current as well as a portion of the load current to be shunted through the interrupter 256. The switching module controller 270 can routinely measure and track the current through the interrupter 256 while the bypass switches 252 and 254 are both closed to gather diagnostic data for analyzing the relative health of the bypass switches 252 and 254 and also interrupter 256. The switching module controller 270 can independently actuate bypass switch 252, bypass switch 254, and the interrupter 256 to verify proper operation. If, for instance, a tap change is aborted due to one of the switches not operating properly, the switching module controller 270 can attempt to verify improper actuation of the suspect switch and re-attempt the tap change if it is found to be operating correctly. Also, the switching module controller 270 can create a record of improper operations and the diagnostic data such as temperature, load current, tap position, and other conditions and the record can be stored in memory and used to generate reports regarding the operation of the voltage regulator system 200.

Figure 8:
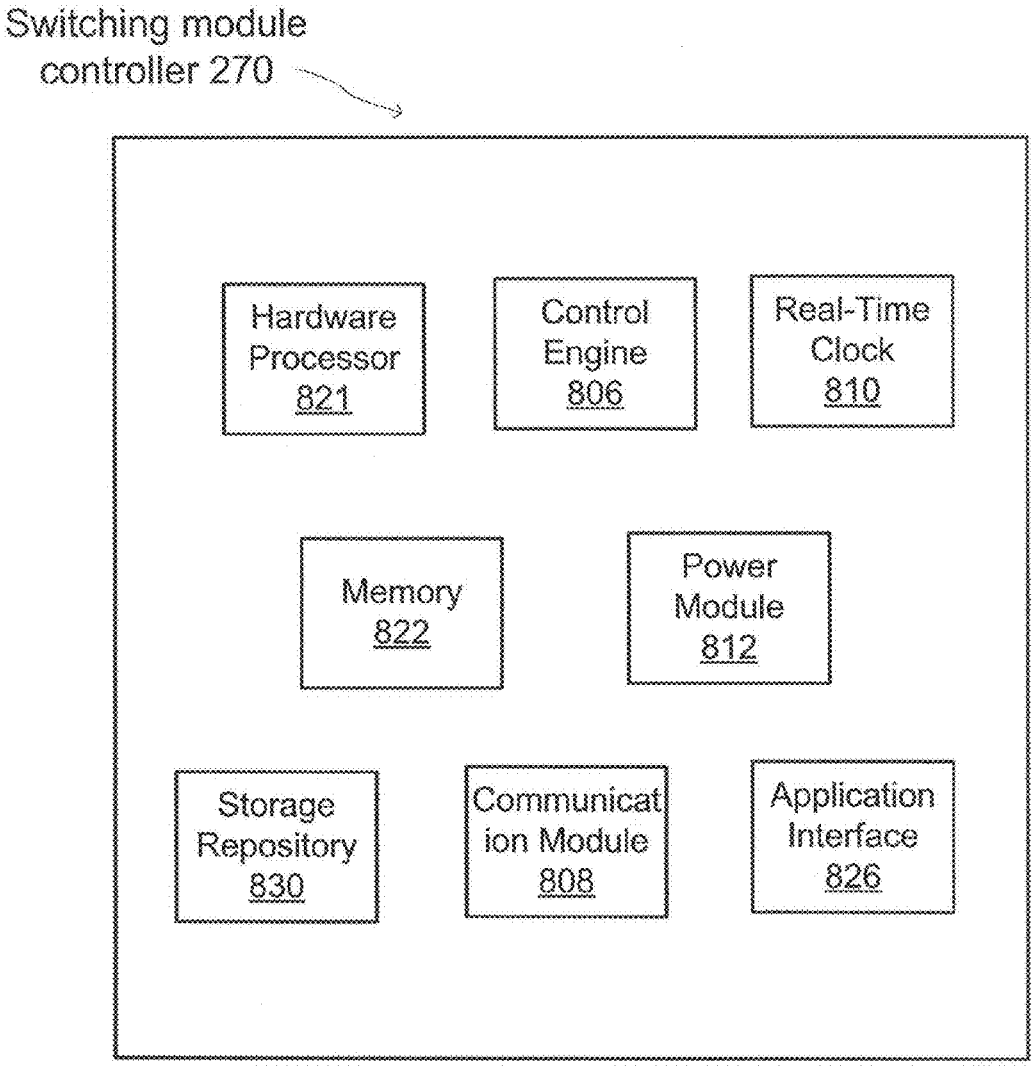
FIG. 8 shows a system diagram of a switching module controller in accordance with certain example embodiments.

Referring now to FIG. 8, a system diagram showing the components of an example switching module controller, such as switching module controller 270, are illustrated and described. The switching module controller 270 can include one or more of a number of components. Such components, can include, but are not limited to, a control engine 806, a communication module 808, a real-time clock 810, a power module 812, a storage repository 830, a hardware processor 821, a memory 822, and an application interface 826. Any component of the switching module controller 270 can be discrete or combined with one or more other components of the switching module controller 270.

Each connection 272, 274, 276 to the switching module controller 270 can include wired (e.g., Class 1 electrical cables, Class 2 electrical cables, leads within a printed circuit board, electrical connectors) and/or wireless (e.g., Wi-Fi, visible light communication, cellular networking, Bluetooth, WirelessHART, ISA100, Power Line Carrier, RS485) technology. For example, connection 272 can be (or include) one or more electrical conductors that are coupled to the switching module controller 270 and to the switching module 250. The connections 272, 274, 276 can transmit signals (e.g., power signals, communication signals, control signals, data) between components of the voltage regulator system 200.

The application interface 826 of the switching module controller 270 can receive data (e.g., information, communications, instructions, updates to firmware) from and send data (e.g., information, communications, instructions) to components of the voltage regulator system 200. The interface 826 can include a graphical user interface, a touchscreen, an application programming interface, a keyboard, a monitor, a mouse, a web service, a data protocol adapter, some other hardware and/or software, or any suitable combination thereof.

The switching module controller 270 can communicate with one or more local or remote computer systems which can include, but are not limited to, a desktop computer with LAN, WAN, Internet or intranet access, a laptop computer with LAN, WAN, Internet or intranet access, a smart phone, a server, a server farm, or a hand-held mobile computing device.

The storage repository 830 can be a persistent storage device (or set of devices) that stores software and data used to assist the switching module controller 270 in performing its functions and in communicating (e.g., sending signals to, receiving signals from) with the other components of the voltage regulator system 200. For example, the storage repository 830 can store communication protocols, algorithms, and stored data. The algorithms can be any procedures that the switching module controller 270 follows based on certain conditions at a point in time. Stored data can be any data associated with the voltage regulator system 200, including measurements, threshold values, results of previously run or calculated algorithms, and/or any other suitable data. The stored data can be associated with time measurements associated with the voltage regulator system 200 that are derived, for example, from the real-time clock 810. Examples of a storage repository 830 can include, but are not limited to, a database (or a number of databases), a file system, a hard drive, flash memory, some other form of solid state data storage, or any suitable combination thereof.

The storage repository 830 can be operatively connected to the control engine 806 of the switching module controller 270. In certain example embodiments, the control engine 806 can control the operation of one or more components (e.g., the communication module 808, the real-time clock 810) of the switching module controller 270. The communication module 808 can send and receive data between the switching module controller 270 and the other components of the voltage regulator system 200. The communication module 808 can send and/or receive data in a given format that follows a particular communication protocol. The control engine 806 can interpret the data received from the communication module 808 using the communication protocol information stored in the storage repository 830. The communication module can receive firmware updates to modify the functions and parameters of the switching module controller 270.

The real-time clock 810 of the switching module controller 270 can track clock time, intervals of time, an amount of time, the number of occurrences of an event, and/or any other measure of time. The real-time clock 810 can track time periods based on an instruction received from the control engine 806, based on an instruction received from a user, based on an instruction programmed in the software operating on the switching module controller 270, or based on some other condition or from some other component. As one example, the real-time clock 810 can measure the amount of time needed to complete each step of a tap changing operation to ensure that the voltage regulator system 200 is operating properly.

The power module 812 provides power to one or more other components (e.g., real-time clock 810) of the switching module controller 270. The power module 812 can include one or more of a number of single or multiple discrete components (e.g., transistor, diode, resistor, capacitor), and/or a microprocessor. In some cases, the power module 812 can include one or more components that allow the power module 812 to measure one or more elements of power (e.g., voltage, current, frequency, inductance, impedance) that that can be measured at one or more points within the voltage regulator system 200. The power module 812 can include one or more components (e.g., a transformer, a diode bridge, an inverter, a converter) that receives power (for example, through an electrical cable) from a source external to the switching module controller 270 and creates power of a type (e.g., alternating current, direct current) and level (e.g., 12V, 24V, 120V) that can be used by the other components of the voltage regulator system 200. In addition, or in the alternative, the power module 812 can be a source of power in itself, such as a battery, to provide signals to the other components of the voltage regulator system 200.

The hardware processor 821 of the switching module controller 270 executes software, algorithms, and firmware in accordance with one or more example embodiments. Specifically, the hardware processor 821 can execute software on the control engine 806. The hardware processor 821 can be an integrated circuit, a central processing unit, a multi-core processing chip, a multi-chip module including multiple multi-core processing chips, or other hardware processor in one or more example embodiments. In one or more example embodiments, the hardware processor 821 executes software instructions stored in memory 822, which can include volatile and/or non-volatile memory. In certain example embodiments, a field programmable gate array can be used instead of or in addition to hardware processor 821.

Various techniques are described herein in the general context of software or program modules. Generally, software includes routines, programs, objects, components, data structures, and so forth that perform particular tasks or implement particular abstract data types. An implementation of these modules and techniques can be stored on a non-transitory computer storage medium.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A voltage regulator comprising:

a tap selector switch comprising a first stationary contact, a second stationary contact, a first movable contact, and a second movable contact;

a switching module comprising:

an interrupter switch;

a first bypass switch electrically coupled to the first movable contact;

a second bypass switch electrically coupled to the second movable contact;

a bypass actuator coupled to and configured to actuate at least one of the first bypass switch and the second bypass switch; and an interrupter actuator coupled to and configured to actuate the interrupter switch; and a switching module controller configured to:

receive a command from a voltage regulator control to move the first movable contact;

determine a position of the first movable contact and the second movable contact;

actuate the bypass actuator to open the first bypass switch and wait a first predetermined time;

actuate the interrupter actuator to open the interrupter and wait a second predetermined time;

actuate the tap selector switch to move the first movable contact and wait a third predetermined time;

actuate the interrupter actuator to close the interrupter and wait a fourth predetermined time; and actuate the bypass actuator to close the first bypass switch.

2. The voltage regulator of claim 1, wherein the switching module controller receives time measurements and compares the time measurements to the first predetermined time, the second predetermined time, the third predetermined time, and the fourth predetermined time.

3. The voltage regulator of claim 2, wherein the switching module controller generates a diagnostic report for the voltage regulator based on the comparison of the time measurements and the first predetermined time, the second predetermined time, the third predetermined time, and the fourth predetermined time.

4. The voltage regulator of claim 1, further comprising a preventative autotransformer electrically coupled in series between the switching module and the tap selector switch.

5. The voltage regulator of claim 4, further comprising an equalizer winding located in series between the preventative autotransformer and the switching module.

6. The voltage regulator of claim 1, further comprising:

a source terminal coupled to a series winding, the series winding coupled to the tap selector switch; and a load terminal coupled to the switching module.

7. The voltage regulator of claim 1, wherein the switching module controller comprises one of an integrated circuit, a programmable logic controller, and a mechanical switch fir actuating the bypass actuator, the interrupter actuator, and the tap selector switch.

8. A voltage regulator comprising:

a tap selector switch comprising a first stationary contact, a second stationary contact, a first movable contact, and a second movable contact;

a switching module comprising:

an interrupter switch;

a first bypass switch electrically coupled to the first movable contact;

a second bypass switch electrically coupled to the second movable contact;

a bypass actuator coupled to and configured to actuate at least one of the first bypass switch and the second bypass switch; and an interrupter actuator coupled to and configured to actuate the interrupter switch; and a switching module controller configured to:

receive a command from a voltage regulator control to move the first movable contact to a new position;

determine a position of the first movable contact and the second movable contact;

actuate the bypass actuator to open the first bypass switch;

receive a first signal from a sensor that the first bypass switch is open;

actuate the interrupter actuator to open the interrupter;

receive a second signal from the sensor that the interrupter is open;

actuate the tap selector switch to move the first movable contact and determine that the first movable contact is in the new position;

actuate the interrupter actuator to close the interrupter;

receive a third signal from a sensor that the interrupter is closed; and actuate the bypass actuator to close the first bypass switch.

9. The voltage regulator of claim 8, wherein the first signal, the second signal, and the third signal are received from a current transformer positioned adjacent the interrupter.

10. The voltage regulator of claim 8, wherein the first signal is received from a first current transformer and the second signal and the third signal are received from a second current transformer.

11. The voltage regulator of claim 8, wherein the switching module controller receives:

a first time measurement of time required to open the first bypass switch;

a second time measurement of time required to open the interrupter;

a third time measurement of time required to complete movement of the first movable contact of the tap selector switch;

a fourth time measurement of time required to close the interrupter; and a fifth time measurement of time required to close the first bypass switch.

12. The voltage regulator of claim 11, wherein at least one of the first time measurement, the second time measurement, the third time measurement, the fourth time measurement, and the fifth time measurement are compared to an expected time and the switching module controller generates a diagnostic report based on the comparison.

13. A voltage regulator comprising:

a tap selector switch comprising a first stationary contact, a second stationary contact, a first movable contact, and a second movable contact;

a switching module comprising:

an interrupter switch;

a first bypass switch electrically coupled to the first movable contact;

a second bypass switch electrically coupled to the second movable contact;

a bypass actuator coupled to and configured to actuate at least one of the first bypass switch and the second bypass switch; and an interrupter actuator coupled to and configured to actuate the interrupter switch; and a switching module controller configured to:

receive a command from a voltage regulator control to move the first movable contact to a new position;

determine a position of the first movable contact and the second movable contact;

actuate the bypass actuator to open the first bypass switch;

receive a first current measurement of the interrupter indicating that the first bypass switch is open;

actuate the interrupter actuator to open the interrupter;

receive a second current measurement of the interrupter indicating that the interrupter is open;

actuate the tap selector switch to move the first movable contact and determine that the first movable contact is in the new position;

actuate the interrupter actuator to close the interrupter;

receive a third current measurement of the interrupter indicating that the interrupter is closed; and actuate the bypass actuator to close the first bypass switch.

14. The voltage regulator of claim 13, wherein a dielectric fluid temperature measurement and a baseline current measurement of the interrupter are received at the switching module controller before opening the first bypass switch.

15. The voltage regulator of claim 13, wherein the switching module controller is further configured to, after actuating the bypass actuator to close the first bypass switch, receive a fourth current measurement of the interrupter indicating that the first bypass switch is closed.

16. The voltage regulator of claim 15, wherein the first current measurement and the fourth current measurement indicate a change in amplitude or phase of current passing through the interrupter due to a change in position of the first bypass switch.

17. The voltage regulator of claim 13, wherein the switching module controller receives:

a first time measurement of time required to open the first bypass switch;

a second time measurement of time required to open the interrupter;

a third time measurement of time required to complete movement of the first movable contact of the tap selector switch;

a fourth time measurement of time required to close the interrupter; and a fifth time measurement of time required to close the first bypass switch.

18. The voltage regulator of claim 17, wherein at least one of the first time measurement, the second time measurement, the third time measurement, the fourth time measurement, and the fifth time measurement are compared to an expected time and the switching module controller generates a diagnostic report based on the comparison.

19. The voltage regulator of claim 13, wherein if one of the first current measurement, the second current measurement, and the third current measurement is inconsistent with a predetermined setting, the switching module controller sends an error message to the voltage regulator control.

20. The voltage regulator of claim 13, wherein the first current measurement, the second current measurement, and the third current measurement are received from a current transformer positioned adjacent the interrupter.

* * * * *